US007655134B2

(12) United States Patent
Dierickx et al.

(10) Patent No.: US 7,655,134 B2
(45) **Date of Patent: *Feb. 2, 2010**

(54) PROCESS TO PREPARE A BASE OIL

(75) Inventors: Jan Lodewijk Maria Dierickx, Amsterdam (NL); Arend Hoek, Amsterdam (NL); Lip Piang Kueh, Sarawak (MY)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/667,911

(22) PCT Filed: Nov. 18, 2005

(86) PCT No.: PCT/EP2005/056052

§ 371 (c)(1),
(2), (4) Date: Mar. 11, 2008

(87) PCT Pub. No.: WO2006/053893

PCT Pub. Date: May 26, 2006

(65) Prior Publication Data

US 2008/0314800 A1 Dec. 25, 2008

(30) Foreign Application Priority Data

Nov. 18, 2004 (EP) ..... 04105883

(51) Int. Cl.
*C10G 65/16* (2006.01)

(52) U.S. Cl. ..... 208/79; 208/78; 208/134; 208/135; 208/136; 208/137; 208/138; 208/141

(58) Field of Classification Search ..... 208/78, 208/79, 80, 133, 134, 136, 137, 141, 138; 518/726, 728

See application file for complete search history.

(56) References Cited

U.S. PATENT DOCUMENTS

| | | | | |
|---|---|---|---|---|
| 2,833,698 | A | 5/1958 | Patton et al. | 196/28 |
| 4,574,043 | A | 3/1986 | Chester et al. | 208/59 |
| 4,859,311 | A | 8/1989 | Miller | 208/89 |
| 4,943,672 | A | 7/1990 | Hamner et al. | 585/737 |
| 5,053,373 | A | 10/1991 | Zones | 502/64 |

(Continued)

FOREIGN PATENT DOCUMENTS

| | | |
|---|---|---|
| EP | 587246 | 3/1994 |

(Continued)

OTHER PUBLICATIONS

Ryland, Lloyd B., Tamele, M.W., and Wilson, J.N., Cracking Catalysts, Catalysis: vol. VII, Ed. Paul H. Emmett, Reinhold Publishing Corporation, New York, 1960, pp. 5-9.

*Primary Examiner*—Robert J Hill, Jr.
*Assistant Examiner*—Brian McCaig

(57) ABSTRACT

Process to optimize the yield of base oils from a Fischer-Tropsch derived feed by performing the following steps (a) performing a hydroconversion/hydroisomerization step on part of the Fischer-Tropsch derived feed; (b) performing a hydroconversion/hydroisomerization step on another part of the Fischer-Tropsch feed at a conversion greater than the conversion in step (a); and (c) isolating by means of distillation a fraction boiling in the base oil range from the two reaction products obtained in steps (a) and (b) and performing a pour point reducing step on said fraction.

7 Claims, 2 Drawing Sheets

U.S. PATENT DOCUMENTS

| | | | | |
|---|---|---|---|---|
| 5,059,299 | A | 10/1991 | Cody et al. | 208/27 |
| 5,157,191 | A | 10/1992 | Bowes et al. | 585/533 |
| 5,252,527 | A | 10/1993 | Zones | 502/64 |
| 2003/0119924 | A1 | 6/2003 | Moore, Jr. et al. | 518/728 |
| 2006/0144755 | A1 | 7/2006 | Benazzi et al. | 208/108 |

FOREIGN PATENT DOCUMENTS

| | | | |
|---|---|---|---|
| EP | 668342 | | 8/1995 |
| EP | 582347 | | 9/1996 |
| EP | 776959 | | 6/1997 |
| EP | 832171 | | 4/1998 |
| WO | WO9201657 | | 2/1992 |
| WO | WO9220759 | | 11/1992 |
| WO | WO9410264 | | 5/1994 |
| WO | WO9718278 | | 5/1997 |
| WO | WO9920720 | | 4/1999 |
| WO | WO9934917 | | 7/1999 |
| WO | WO0029511 | | 5/2000 |
| WO | WO0157160 | | 8/2001 |
| WO | WO 02070627 | A2 * | 9/2002 |
| WO | WO02070628 | | 9/2002 |
| WO | WO02070629 | | 9/2002 |
| WO | WO2004076598 | | 9/2004 |

* cited by examiner

PROCESS TO PREPARE A BASE OIL

PRIORITY CLAIM

The present application claims priority to European Patent Application 04105883.5 filed 18 Nov. 2004.

FIELD OF THE INVENTION

The invention is directed to a process to prepare base oil from a Fischer-Tropsch derived synthesis product.

BACKGROUND OF THE INVENTION

WO-A-02070629 describes a process to prepare a gas oil product and a base oil product from a Fischer-Tropsch derived synthesis product by performing a hydroconversion/hydroisomerisation step and isolation of a gas oil fraction and a residue from the obtained cracked effluent. The gas oil as obtained had an iso-paraffin content of 80 wt %. The residue is further distilled to obtain a distillate fraction boiling between 370 and 510° C. This fraction boiling between 370 and 510° C. was subjected to a catalytic dewaxing step to obtain various base oil grades.

The present invention provides a process to optimise the yield to base oils from a Fischer-Tropsch derived synthesis product.

SUMMARY OF THE INVENTION

The following process provides a way to optimize the yield of base oils from a Fischer-Tropsch derived feed by performing the following steps (a) performing a hydroconversion/hydroisomerisation step on part of the Fischer-Tropsch derived feed;

(b) performing a hydroconversion/hydroisomerisation step on another part of the Fischer-Tropsch feed at a conversion greater than the conversion in step (a); and (c) isolating by means of distillation a fraction boiling in the base oil range from the two reaction products obtained in steps (a) and (b) and performing a pour point reducing step on said fraction.

Applicants found that by performing steps (a) and (b) in parallel at different conversion levels, it is possible to optimize the yield of the waxy raffinate fraction and thus to the base oils which are obtained after subjecting this fraction to a pour point reducing step.

DETAILED DESCRIPTION OF THE INVENTION

Figure 1:
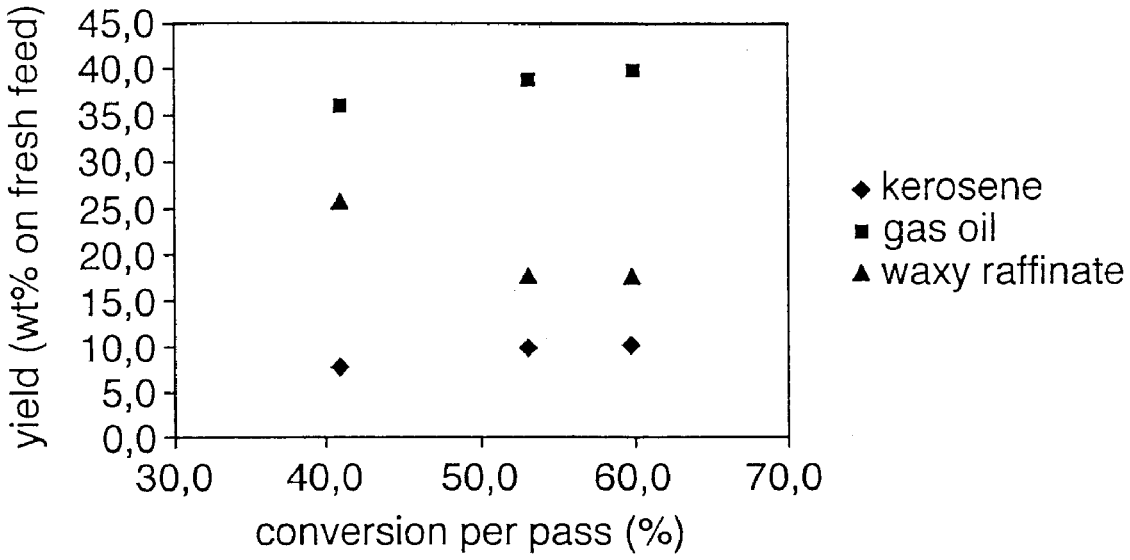
FIG. 1 is a graphical presentation of the results of Example 1 and the comparative example A.

The Fischer-Tropsch derived feed used in step (a) and in step (b) will comprise a Fischer-Tropsch synthesis product. With a Fischer-Tropsch synthesis product is meant the product directly obtained from a Fischer-Tropsch synthesis reaction, which product may optionally have been subjected to a distillation and/or hydrogenation step only. The Fischer-Tropsch synthesis product can be obtained by well-known processes, for example the so-called commercial Slurry Phase Distillate technology of Sasol, the Shell Middle Distillate Synthesis Process or by the non-commercial "AGC-21" Exxon Mobil process. These and other processes are for example described in more detail in EP-A-776959, EP-A-668342, U.S. Pat. No. 4,943,672, U.S. Pat. No. 5,059,299, WO-A-9934917 and WO-A-9920720. Most of these processes are carried out at temperatures between 200 and 280° C., especially 210-260° C. The catalyst contains often cobalt or iron, preferably cobalt. The pressure is suitably between 10 and 80 bar, especially between 20 and 65 bar. The reaction is usually carried out in a fix bed reactor or a slurry reactor. Typically these Fischer-Tropsch synthesis products will comprise hydrocarbons having 1 to 100 and even more than 100 carbon atoms, e.g. up to 200 carbon atoms or occasionally even more. This hydrocarbon product will comprise normal paraffins, iso-paraffins, oxygenated products and unsaturated products. Paraffins and unsaturated product, especially olefins, more especially alpha-olefins, are the main constituents of the Fischer-Tropsch derived feed. Depending on the actual reaction conditions, the amount of olefins may vary from 5 to 90 wt % of the total feed stream. The amount of iso-paraffins (and iso-olefins) also depends on the actual reaction conditions. Usually the amount of iso-compounds is up to 25 wt % of the total feed stream, suitably between 1 and 20 wt %, especially between 3 and 15 wt %. The amount of oxygenates is usually up till 10 wt % of the total feed stream, suitably between 0.5 and 6 wt %.

The feed for the process of the invention is suitably the full $C_5$+ fraction of the Fischer-Tropsch process, i.e. no heavy compounds have been removed from the fraction. Other suitable feeds are the full $C_{12}$+ fraction of the Fischer-Tropsch process or the full $C_{18}$+ fraction, i.e. the 200° C. plus fraction or the 310° C. plus fraction of the Fischer-Tropsch process. Optionally also the fraction boiling above 380° C., or even boiling above 750° C., may be used. Preferably the full high boiling fraction are used, i.e. no heavy compounds, e.g. $C_{21}$+ compounds, are removed from the Fischer-Tropsch product. The process of the present invention is preferably carried out with a Fischer-Tropsch feed which is a relatively heavy product. The relatively heavy Fischer-Tropsch product used in step (a) has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}$+ fraction having an ASF-alpha value (Anderson-Schulz-Flory chain growth factor derived from the $C_{20}$ compounds and the C40 compounds of the Fischer-Tropsch product stream) of at least 0.925, preferably at least 0.935, more preferably at least 0.945, even more preferably at least 0.955.

Preferably any compounds having 4 or less carbon atoms and any compounds having a boiling point in that range are separated from a Fischer-Tropsch synthesis product before the Fischer-Tropsch synthesis product is used in step (a) or (b).

The Fischer-Tropsch derived feed may be simply split into two equal parts and the two parts are used as feed in steps (a) and (b). For the present invention, it is not essential that these two parts are of the same volume. For instance, 25-50 wt % of the total feed may go to step (a) and 75-50 wt % may go to step (b). Furthermore, it may be envisaged that the Fischer-Tropsch product from one or more parallel operated Fischer-Tropsch synthesis reactor types, for example slurry bubble or multi-tubular reactors, are fed to step (a) while one or more other parallel operated Fischer-Tropsch reactor types provide the feed for step (b). It may also be envisaged that all the products from all or almost all of the Fischer-Tropsch synthesis reactors are mixed at a so-called common header and that from this combined product the two feeds for step (a) and (b) may be obtained. It is also part of this invention that in addition to step (a) and (b), more parallel operated hydroconversion/hydrocracking reactors are present. It is understood that the Fischer-Tropsch derived feed will then be split over more than two feeds provided that at least two reactors operate at a different conversion according to the present invention. The feed streams to step (a) and step (b) may be the same feed streams or different feed streams, but are preferably the same. Preferably each feed stream comprises at least 20 wt % of the feed stream of compounds boiling above 360° C., more preferably at least 40 wt %, more preferably at least 60 wt %, still more preferably at least 85 wt %.

The feed for steps (a) and (b) may next to the Fischer-Tropsch derived feed also comprise of mineral crude derived fractions and/or gas field condensates. These additional sulphur containing co-feeds are advantageous when a sulphided catalyst is used in steps (a) and (b). The sulphur in the feed will keep the catalyst in its sulphided form. The sulphur may be removed in a down stream treating unit or, in case the quantities are very low, become part of the product of the present invention.

The hydroconversion/hydroisomerisation reaction of step (a) and (b) is preferably performed in the presence of hydrogen and a catalyst, which catalyst can be chosen from those known to one skilled in the art as being suitable for this reaction of which some will be described in more detail below. The catalyst may in principle be any catalyst known in the art to be suitable for isomerising paraffinic molecules. In general, suitable hydroconversion/hydroisomerisation catalysts are those comprising a hydrogenation component supported on a refractory oxide carrier, such as amorphous silica-alumina (ASA), alumina, fluorided alumina, molecular sieves (zeolites) or mixtures of two or more of these. One type of preferred catalysts to be applied in the hydroconversion/hydroisomerisation step in accordance with the present invention are hydroconversion/hydroisomerisation catalysts comprising platinum and/or palladium as the hydrogenation component. A very much preferred hydroconversion/hydroisomerisation catalyst comprises platinum and palladium supported on an amorphous silica-alumina (ASA) carrier. The platinum and/or palladium is suitably present in an amount of from 0.1 to 5.0% by weight, more suitably from 0.2 to 2.0% by weight, calculated as element and based on total weight of carrier. If both present, the weight ratio of platinum to palladium may vary within wide limits, but suitably is in the range of from 0.05 to 10, more suitably 0.1 to 5. Examples of suitable noble metal on ASA catalysts are, for instance, disclosed in WO-A-9410264 and EP-A-0582347. Other suitable noble metal-based catalysts, such as platinum on a fluorided alumina carrier, are disclosed in e.g. U.S. Pat. No. 5,059,299 and WO-A-9220759.

A second type of suitable hydroconversion/hydroisomerisation catalysts are those comprising at least one Group VIB metal, preferably tungsten and/or molybdenum, and at least one non-noble Group VIII metal, preferably nickel and/or cobalt, as the hydrogenation component. Both metals may be present as oxides, sulphides or a combination thereof. The Group VIB metal is suitably present in an amount of from 1 to 35% by weight, more suitably from 5 to 30% by weight, calculated as element and based on total weight of the carrier. The non-noble Group VIII metal is suitably present in an amount of from 1 to 25 wt %, preferably 2 to 15 wt %, calculated as element and based on total weight of carrier. A hydroconversion catalyst of this type which has been found particularly suitable is a catalyst comprising nickel and tungsten supported on fluorided alumina.

The above non-noble metal-based catalysts are preferably used in their sulphided form. In order to maintain the sulphided form of the catalyst during use some sulphur needs to be present in the feed. Preferably at least 10 ppm and more preferably between 50 and 150 ppm of sulphur is present in the feed.

A preferred catalyst, which can be used in a non-sulphided form, comprises a non-noble Group VIII metal, e.g., iron, nickel, in conjunction with a Group IB metal, e.g., copper, supported on an acidic support. Copper is preferably present to suppress hydrogenolysis of paraffins to methane. The catalyst has a pore volume preferably in the range of 0.35 to 1.10 ml/g as determined by water absorption, a surface area of preferably between 200-500 $m^2/g$ as determined by BET nitrogen adsorption, and a bulk density of between 0.4-1.0 g/ml. The catalyst support is preferably made of an amorphous silica-alumina wherein the alumina may be present within wide range of between 5 and 96 wt %, preferably between 20 and 85 wt %. The silica content as $SiO_2$ is preferably between 15 and 80 wt %. Also, the support may contain small amounts, e.g., 20-30 wt %, of a binder, e.g., alumina, silica, Group IVA metal oxides, and various types of clays, magnesia, etc., preferably alumina or silica.

The preparation of amorphous silica-alumina microspheres has been described in Ryland, Lloyd B., Tamele, M. W., and Wilson, J. N., Cracking Catalysts, Catalysis: volume VII, Ed. Paul H. Emmett, Reinhold Publishing Corporation, New York, 1960, pp. 5-9.

The catalyst is prepared by co-impregnating the metals from solutions onto the support, drying at 100-150° C., and calcining in air at 200-550° C. The Group VIII metal is present in amounts of about 15 wt % or less, preferably 1-12 wt %, while the Group IB metal is usually present in lesser amounts, e.g., 1:2 to about 1:20 weight ratio respecting the Group VIII metal.

A typical catalyst is shown below:

| | |
|---|---|
| Ni, wt % | 2.5-3.5 |
| Cu, wt % | 0.25-0.35 |
| $Al_2O_3$—SiO2 wt % | 65-75 |
| $Al_2O_3$ (binder) wt % | 25-30 |
| Surface Area | 290-325 $m^2/g$ |
| Pore Volume (Hg) | 0.35-0.45 ml/g |
| Bulk Density | 0.58-0.68 g/ml |

Another class of suitable hydroconversion/hydroisomerisation catalysts are those based on zeolitic materials, suitably comprising at least one Group VIII metal component, preferably Pt and/or Pd, as the hydrogenation component. Suitable zeolitic and other aluminosilicate materials, then, include Zeolite beta, Zeolite Y, Ultra Stable Y, ZSM-5, ZSM-12, ZSM-22, ZSM-23, ZSM-48, MCM-68, ZSM-35, SSZ-32, ferrierite, mordenite and silica-aluminophosphates, such as SAPO-11 and SAPO-31. Examples of suitable hydroisomerisation/hydroisomerisation catalysts are, for instance, described in WO-A-9201657 and EP 587246.

The above catalysts are preferably reduced before being used. The metallic catalyst may be obtained as an oxidic or a pre-reduced catalyst. The above catalysts which are used in a sulphided form may be obtained in an oxidic, a pre-sulphided or a presulphurised form. Preferably the start-up procedure of the catalyst manufacturer is followed. Pre-reducing the catalyst for use in a metallic form may also be achieved in situ by reducing the catalyst by contacting with hydrogen. Preferably the contacting is achieved by contacting the catalyst at an elevated temperature with hydrogen in e.g. nitrogen mixture stream. More preferably the hydrogen content is increased over time and/or the temperature is gradually increased. A skilled person will be able to achieve a successful reduction of the catalyst by applying generally applied skills.

In step (a) and (b) the feed is contacted with hydrogen in the presence of the catalyst at elevated temperature and pressure. The temperatures typically will be in the range of from 175 to 425° C., preferably higher than 250° C. and more preferably from 280 to 400° C. The hydrogen partial pressure will typically be in the range of from 10 to 250 bar and preferably between 20 and 100 bar. The hydrocarbon feed may be provided at a weight hourly space velocity of from 0.1 to 5 kg/l/hr (mass feed/volume catalyst bed/time), preferably higher than 0.5 kg/l/hr and more preferably lower than 2 kg/l/hr. Hydrogen may be supplied at a ratio of hydrogen to hydrocarbon feed from 100 to 5000 N1/kg and preferably from 250 to 2500 N1/kg.

Steps (a) and (b) are preferably performed in a reactor provided with beds of the heterogeneous catalyst as described above. Preferably the reactors have the same size. Preferably the reactors have the same type of catalyst.

The conversion in step (a) and (b), which is defined as the weight percentage of the feed boiling above 370° C. which reacts per pass to a fraction boiling below 370° C., is at least 20 wt %, preferably at least 25 wt %, but preferably not more than 90 wt %. The difference in conversion in steps (a) and (b) is preferably more than 5 wt %, more preferably more than 10 wt % and even more preferably more than 15 wt %. The difference will at most be preferably 35 wt %, more preferably 30 wt % still more preferably 25 wt %. Preferably the conversion in step (a) is between 30 and 60 wt %, more preferably between 40 and 55 wt %, and the conversion in step (b) is between 50 and 95 wt %, more preferably between 40 and 80 wt %. The feed as used above in the definition is the total hydrocarbon feed fed to step (a) and (b), thus also any optional recycle of the higher boiling fraction as obtained in a vacuum distillation or an atmospheric distillation as described below for step (c).

Prior to the hydroconversion/hydroisomerisation step (a) and (b) the feed may optionally be subjected to a mild hydrotreatment step, in order to remove any oxygenates and saturate any olefinic compounds present in the reaction product of the Fischer-Tropsch reaction. Preferably the hydrogenation step reduces the level of oxygenates to below 150 ppm as measured by infrared absorption spectrometry and reduces the level of unsaturated compounds to below the detection limit of the infrared absorption spectrometry.

Such a hydrotreatment is for example described in EP-B-668342. The mildness of the hydrotreating step is preferably expressed in that the degree of conversion in this step is less than 20 wt % and more preferably less than 10 wt %, even more preferably less then 5 wt %. The conversion is here defined as the weight percentage of the feed boiling above 370° C., which reacts to a fraction boiling below 370° C. After such a mild hydrotreatment, lower boiling compounds, having four or less carbon atoms and other compounds boiling in that range, will preferably be removed from the effluent before it is used in step (a). Examples of suitable catalysts are noble metal catalyst as for example platinum based hydrogenation catalysts or non-noble catalysts such as high content nickel catalysts.

In step (c) a fraction is obtained from the reaction products of steps (a) and (b) which boil in the base oil boiling range. In one embodiment the effluents of steps (a) and (b) are combined and subsequently distilled. Alternatively the fractions are combined after separate distillation of the effluents of steps (a) and (b). First an atmospheric distillation is suitably performed in order to isolate the middle distillates and lower boiling products obtained in steps (a) and (b). The residual fraction of said distillation will boil suitably in the base oil boiling range. The fraction preferably has a T10 wt % boiling point of between 200 and 450° C. and preferably between 300 and 420° C. The fraction may comprise the entire residual fraction of the atmospheric distillation. Such a residual fraction may have a T98 wt % recovery point of greater than 600° C. The feed can also be a fraction of step (a) and (b) effluents. Such a fraction is preferably obtained in a vacuum distillation step, and has a T90 wt % boiling point of between 400 and 550° C., preferably between 450 and 550° C. if base oils are targeted having a kinematic viscosity at 100° C. of between 3 and 9 cSt. The Txx Wt %, wherein xx is between 1 and 98, boiling points in this context are the xxth percentiles of the true boiling point distribution as measured by a gas chromatographic simulation as in IP 480-02.

The pour point reducing step may be a solvent dewaxing treatment. Preferably this treatment is a catalytic pour point reducing treatment step. With the catalytic pour point reducing treatment is understood every process wherein the pour point, as measured by ASTM D 97, of the base oil is reduced by more than 10° C., preferably more than 20° C., more preferably more than 25° C.

The catalytic pour point reducing process can be performed by any process wherein, in the presence of a catalyst and hydrogen the pour point of the fraction after processing is improved, as specified above. Suitable dewaxing catalysts are heterogeneous catalysts comprising a molecular sieve optionally in combination with a metal having a hydrogenation function, such as the Group VIII metals. Preferred molecular sieves are intermediate pore size zeolites. Preferably the intermediate pore size zeolites have a pore diameter of between 0.35 and 0.8 nm. Suitable intermediate pore size zeolites and other aluminosilicate materials are zeolite beta mordenite, ZSM-5, ZSM-12, ZSM-22, ZSM-23, MCM-68, SSZ-32, ZSM-35 and ZSM-48. Another preferred group of molecular sieves are the silica-aluminophosphate (SAPO) materials of which SAPO-11 is most preferred as for example described in U.S. Pat. No. 4,859,311. ZSM-5 may optionally be used in its HZSM-5 form in the absence of any Group VIII metal. The other molecular sieves are preferably used in combination with an added Group VIII metal, or mixtures of said metals. Suitable Group VIII metals are nickel, cobalt, platinum and palladium. Examples of possible combinations are Pt/Zeolite beta, PtPd/Zeolite beta, Ni/ZSM-5, Pt/ZSM-23, Pd/ZSM-23, Pt/ZSM-48, Pt/ZSM-12 and Pt/SAPO-11. Further details and examples of suitable molecular sieves and dewaxing conditions are for example described in WO-A-9718278, U.S. Pat. No. 5,053,373, U.S. Pat. No. 5,252,527 and U.S. Pat. No. 4,574,043.

The crystallite size of the aluminosilicate zeolite may be as high as 100 micron. Preferably small crystallites are used in order to achieve an optimum catalytic activity. Preferably crystallites smaller than 10 micron and more preferably smaller than 1 micron are used. The practical lower limit is suitably 0.1 micron as measured by XRD line broadening. The critical size to measure is the length of the crystallite in the direction of the pores.

The dewaxing catalyst suitably also comprises a binder. The binder can be a synthetic or naturally occurring (inorganic) substance, for example clay, and/or metal oxides. Natural occurring clays are for example of the montmorillonite and kaolin families. The binder is preferably a porous binder material, for example a refractory oxide of which examples are: silica, alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material which is essentially free of alumina is used. Examples of these binder materials are silica, zirconia, titanium dioxide, germanium dioxide, and mixtures of two or more of these of which examples are listed above. The most preferred binder is silica.

A preferred class of dewaxing catalysts comprise intermediate pore size zeolite crystallites as described above and a low acidity refractory oxide binder material which is essentially free of alumina as described above. Preferably the zeolite has been subjected to a dealumination treatment such as steaming. More preferably the surface of the aluminosilicate zeolite crystallites has been modified by subjecting the aluminosilicate zeolite crystallites to a surface dealumination treatment. A preferred surface dealumination treatment is by contacting an extrudate of the binder and the zeolite with an aqueous solution of a fluorosilicate salt as described in for example U.S. Pat. No. 5,157,191 or WO-A-2000029511. Examples of suitable dewaxing catalysts as described above are silica bound and dealuminated Pt/ZSM-5, silica bound and dealuminated Pt/ZSM-23, silica bound and dealuminated Pt/ZSM-12, silica bound and dealuminated Pt/ZSM-22 as for example described in WO-A-200029511 and EP-B-832171.

Catalytic dewaxing conditions are known in the art and typically involve operating temperatures in the range of from 200 to 500° C., suitably from 250 to 400° C., hydrogen pressures in the range of from 10 to 200 bar, preferably from 15 to 100 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 normal litres of hydrogen per litre of oil. By varying the temperature between 280 and 380° C. at a pressure of between 15-100 bars, in the catalytic dewaxing step it has been found possible to prepare base oils having different pour points varying from suitably lower than below the lowest measurable pour point, which is around −60° C. to up to 0° C.

After performing the pour point reducing treatment and if required lower boiling compounds formed during said treatment are suitably removed, preferably by means of a vacuum distillation, flashing step or a stripping step or combinations of said steps. One or more base oils grades may be obtained by distillation of the dewaxed product. Preferably such a distillation is performed in one distillation step performed under low pressure.

The base oil products may be blended with other types of base oils, for example with base oils obtained from a mineral petroleum crude source or base oils as prepared by means of oligomerisation of lower olefins, for example $C_3$-$C_{12}$ olefins and/or from $C_4$-$C_{12}$ di-olefins. Preferably these other base oils are co-fed to the pour point reducing step with the fractions obtained in step (c). In this manner a base oil having just the targeted pour point, viscosity and Noack volatility is advantageously obtained.

The base oil products preferably comprise of at least a medium grade base oil having a kinematic viscosity at 100° C. of between 3.0 and 5.6 cSt and a heavy base oil grade having a kinematic viscosity at 100° C. of greater than 6 cSt. The upper viscosity limit will depend on the fractions of heavy Fischer-Tropsch compounds that are still present in the feed to the catalytic dewaxing unit and may range to 30 cSt at 100° C. The Noack volatility of the medium grade base oil is preferably between 9 and 40% more preferably between 9 and 25%. Typical distillation operations will be suited to obtain base oils having the current volatility specifications of base oils in general. The viscosity index may range from 110 for the lower viscosity grades to up to 170 for the more viscous grades. The viscosity index (VI) will also depend on the severity of the dewaxing step wherein lower VI values are found for base oils having a lower pour point.

Figure 2:
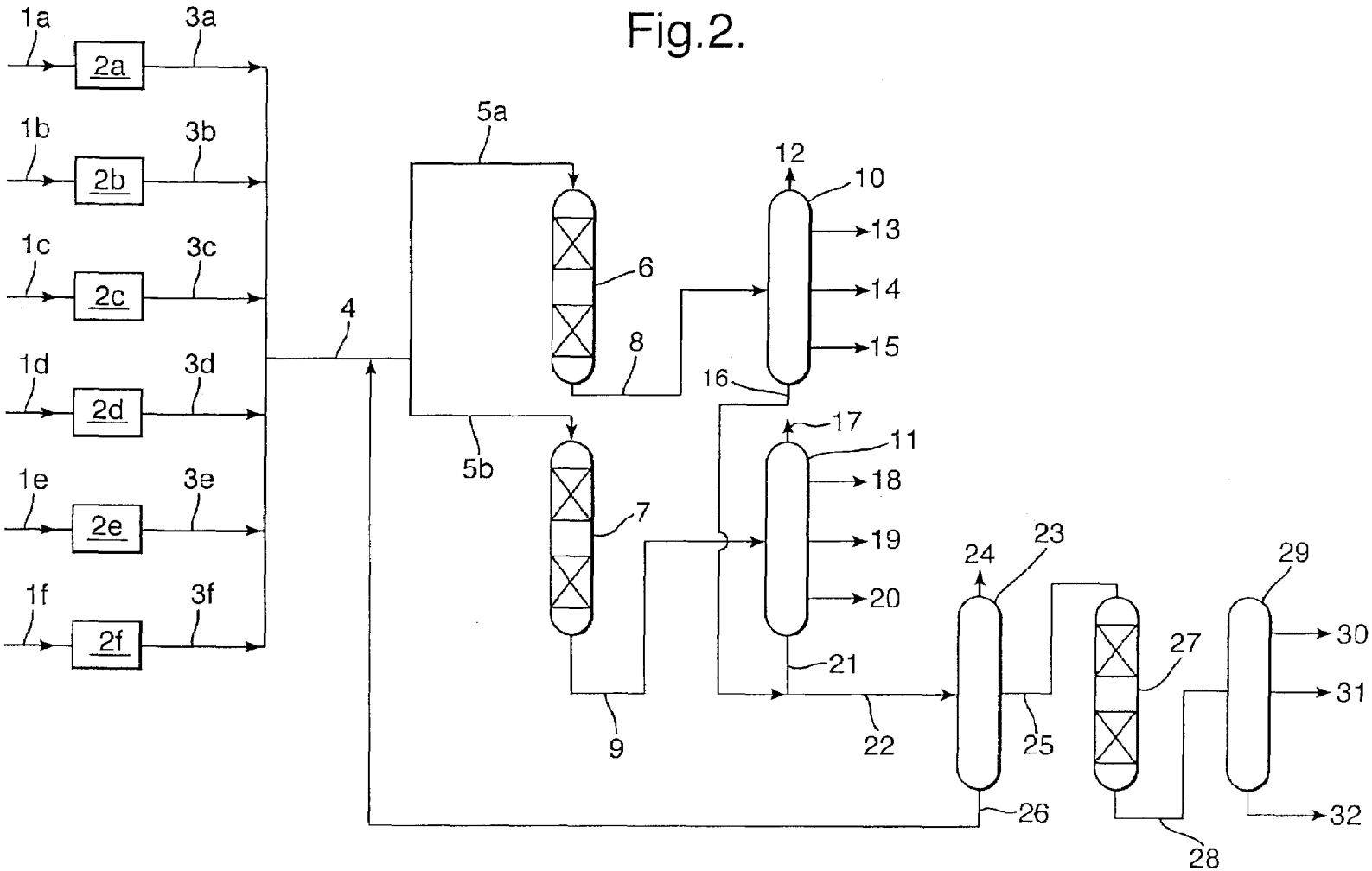
FIG. 2 is a schematic presentation of an embodiment of the process according to the present invention.

FIG. 2 shows a process scheme in which the process according to the present invention may suitably be carried out. In FIG. 2 a mixture of carbon monoxide and hydrogen (1*a*-1*f*) is fed to 6 parallel-operated Fischer-Tropsch synthesis reactors (2*a*-2*f*). The Fischer-Tropsch products (3*a*-3*f*) as prepared in said reactors are typically recovered as a liquid product and a gaseous product. The gaseous products are condensed and combined with the liquid products. This is not shown in this Figure in order to not complicate the Figure too much. The different products (3*a*-3*f*) are combined to one product stream (4). Stream (4) is mixed with a recycle stream (26) and split into two feeds (5*a*) and (5*b*) which are fed to two parallel-operated hydroconversion/hydroisomerisation reactors (6, 7). These reactors operate at different conditions in order to achieve the different conversion according to the process of the present invention. The reactors (6, 7) are provided with stacked beds of catalyst as schematically drawn. The effluents (8, 9) of the reactors (6, 7) are separately distilled in distillation columns (10, 11) operating at atmospheric conditions. In these columns different distillate products are obtained, namely light overhead products (12, 17), a naphtha product (13, 18), a kerosene product (14, 19), a gas oil product (15, 20) and a distillation residue fraction (16, 21). These two residue fractions are combined (22) and further distilled at reduced pressure to yield a vacuum gas oil fraction (23), a waxy raffinate (25) and a bottoms fractions (26). The waxy raffinate fraction is catalytically dewaxed in reactor (27) to yield a dewaxed oil (28). The dewaxed oil (28) is separated in a distillation column (29) operated at reduced pressure into base oils (30, 31, 32) having different viscosities. The base oil boiling range is suitably at least 150° C., preferably a T10 wt % of 200 up till 450° C. and a final boiling point up till 850° C., preferably a T90 wt % between 400 and 550° C.

The invention will be illustrated by the following non-limiting examples.

Example 1

Hydrogen and carbon monoxide synthesis gas ($H_2$:CO=2.05 mole/mole.) were converted to heavy paraffins in a tubular Fischer-Tropsch reactor. The catalyst utilized for the Fischer-Tropsch reaction was a titania supported cobalt/manganese catalyst previously described in WO-A-9934917 The pressure was 61 bar, and temperature was adjusted to maintain a Space Time Yield (STY) of 208 kg product per $m^3$ catalyst bed and per hour. The alpha of the Fischer-Tropsch synthesis step was 0.96. The $C_4$ and compounds boiling below said compounds were separated and a substantially $C_5$ plus fraction as further described in Table 1 was obtained as a liquid wax and a gaseous fraction, which was subsequently condensed.

TABLE 1

| Fischer-Tropsch synthesis product used as feed was a mixture of the condensed product and the wax as obtained in the F-T reaction | Condensed product | Wax |
|---|---|---|
| Feed space velocity (kg feed/1 catalyst bed/h) | .1 | .9 |
| Density (kg/m$^3$) | 754.9 at 15° C. | 749.1 at 150° C., 733.3 at 175° C. |
| Initial boiling point (° C.) | <5 | 139 |
| T10wt % boiling point (° C.) | 72 | 403 |
| T30wt % boiling point (° C.) | 151 | 560 |
| T50wt % boiling point (° C.) | 209 | 680 |
| T70wt % boiling point (° C.) | 254 | 741 |
| T90wt % boiling point (° C.) | 318 | >746 |
| Final boiling point (° C.) | 450 | >746 |
| Oxygenates by IR absorption spectrometry | | |
| Aldehydes + ketones (ppmw O) | 615 | 360 |
| Esters (ppmw O) | 130 | 400 |
| Acids + anhydrides (ppmw O) | <5 | 145 |
| Primary alcohols (ppmw O) | 1135 | 450 |
| Secondary alcohols (ppmw O) | 820 | 375 |

The product of Table 1 was split into two equal fractions having the same properties. Both fractions were subjected to a parallel-operated hydroconversion/hydroisomerisation step wherein the feed was contacted with a 0.8 wt % platinum on amorphous silica-alumina carrier. The conditions in both hydroconversion/hydroisomerisation steps were: a fresh feed Weight Hourly Space Velocity (WHSV) of 1.0 kg/(l.h), and hydrogen gas rate=1000 N1/kg feed. The total pressure is the first reactor was 31 bar. From the effluent of the hydroisomerisation step a fraction boiling above 540° C. was recycled to said hydroconversion/hydroisomerisation step.

In both reactors the temperature was varied such that in one reactor a conversion per pass of 41 wt % and in the second reactor a conversion per pass of 60 wt % was achieved. The two hydroisomerisation effluents were combined. From the combined effluents a waxy raffinate fraction was isolated having the properties and yields as listed in Table 2.

The waxy raffinate was subjected to a catalytic dewaxing step by contacting the waxy raffinate with a Pt-ZSM-12/silica bound catalyst at a temperature of 299° C., a pressure of 30 bar hydrogen, a hydrogen gas rate of 1000 N1/kg feed to yield a base oil having a kinematic viscosity at 100° C. of 4 cSt boiling between 405 and 470° C. and a pour point of −19° C.

Comparative A

Example 1 was repeated except that the gas oil and waxy raffinate were only made in one reactor at a conversion per pass of 53 wt %. From the effluent a waxy raffinate fraction was isolated having the properties and yields as listed in Table 2.

TABLE 2

| | Example 1 reactor 1 | Example 1 reactor 2 | Comp. A |
|---|---|---|---|
| Conversion | 41 | 60 | 53 |
| Yield of Waxy Raffinate boiling between 400 and 540° C. (tons/hour) | 26 | 18 | 18 |
| Wax content of waxy raffinate (wt %) | 6.1 | 2.5 | 3.8 |
| Base oil yield (tons/hour) boiling between 300 and 500° C. having a pour point of −21° C. | 5.9 | 4.0 | 4.0 |

Fresh Feed = 100 tons/hour

The results of Table 2 have been plotted in FIG. 1. As is shown in this Figure is that the combined yield of the reactors 1 and 2 in Example 1 of waxy raffinate is 3 wt % (absolute) higher than in Comparative Experiment A. The difference in yield in the vertical difference between the yield point at 53 wt % and the straight lines between the 41 and 60 wt % conversion points. This clearly shows the advantages of operating two hydroconversion reactors in parallel at different conversion levels.

We claim:

1. A process to optimize the yield of base oils from a Fischer-Tropsch derived feed comprising:

(a) performing a hydroconversion/hydroisomerisation step on part of a Fischer-Tropsch derived feed to obtain a reaction product, the feed comprising at least 50 wt % of compounds having at least 30 carbon atoms;

(b) performing a hydroconversion/hydroisomerisation step on another part of the Fischer-Tropsch feed to obtain a reaction product, the feed comprising at least 50 wt % of compounds having at least 30 carbon atoms, at a conversion greater than the conversion in step (a); and (c) isolating by means of distillation a fraction boiling in the base oil range from the two reaction products obtained in steps (a) and (b) and performing a pour point reducing step on said fraction.

2. A process according to claim 1, wherein the feed stream to step (a) and to step (b) each comprises at least 55 wt % of compounds having at least 30 carbon atoms.

3. A process according to claim 1, wherein the conversion is step (a) is between 40 and 55 wt % and the conversion in step (b) is between 50 and 65 wt %.

4. A process according to claim 1, wherein the difference between the conversion of step (a) and step (b) is between 5 and 35 wt %.

5. A process according to claim 1, wherein the hydroconversion/hydroisomerisation step of step (a) and (b) are performed in two parallel continuously operated reactors each provided with a heterogeneous hydroconversion/hydroisomerisation catalyst.

6. A process according to claim 5, wherein the two parallel operated reactors are the same size.

7. A process according to claim 1, wherein isolation of the fractions boiling in the base oil range from the two reaction products obtained in steps (a) and (b) in step (c) is performed in the same distillation step.

* * * * *